United States Patent [19]

Dean et al.

[11] Patent Number: 4,546,869

[45] Date of Patent: Oct. 15, 1985

[54] COIN TESTING APPARATUS

[75] Inventors: Robert Dean, Farnham Common; Peter J. Reyner, Northwood, both of United Kingdom; Frederic P. Heiman, Philadelphia, Pa.

[73] Assignee: Mars Incorporated, McLean, Va.

[21] Appl. No.: 464,930

[22] Filed: Feb. 8, 1983

[30] Foreign Application Priority Data

Feb. 12, 1982 [GB] United Kingdom ..... 8204256

[51] Int. Cl.[4] ..... G07F 3/02

[52] U.S. Cl. ..... 194/99; 194/100 A

[58] Field of Search ..... 194/99, 100 R, 100 A; 324/202, 236

[56] References Cited

U.S. PATENT DOCUMENTS 3,317,016 5/1967 Turillon .
3,918,565 11/1975 Fougere et al. ..... 194/100 A
3,956,692 5/1976 Weinberg ..... 194/100 R X

FOREIGN PATENT DOCUMENTS 1527450 10/1978 United Kingdom ..... 194/100 A

*Primary Examiner*—F. J. Bartuska
*Attorney, Agent, or Firm*—Davis Hoxie Faithfull & Hapgood

[57] ABSTRACT

The operation of a coin testing apparatus is checked by switching the apparatus to a test mode. In the test mode, the properties of items inserted into the apparatus are compared with stored "test" ranges, instead of "acceptability" ranges which are normally used to determine whether the item is a genuine coin. A specially designed non-genuine coin is then inserted into the apparatus. If the measured properties of the non-genuine coin fall within the "test" ranges, a signal is produced to indicate that the apparatus is operating correctly. If any of the properties falls outside a "test" range, but within a further, contiguous range, a signal indicates that the apparatus is working adequately, but not optimally.

25 Claims, 6 Drawing Figures

Figure 1:
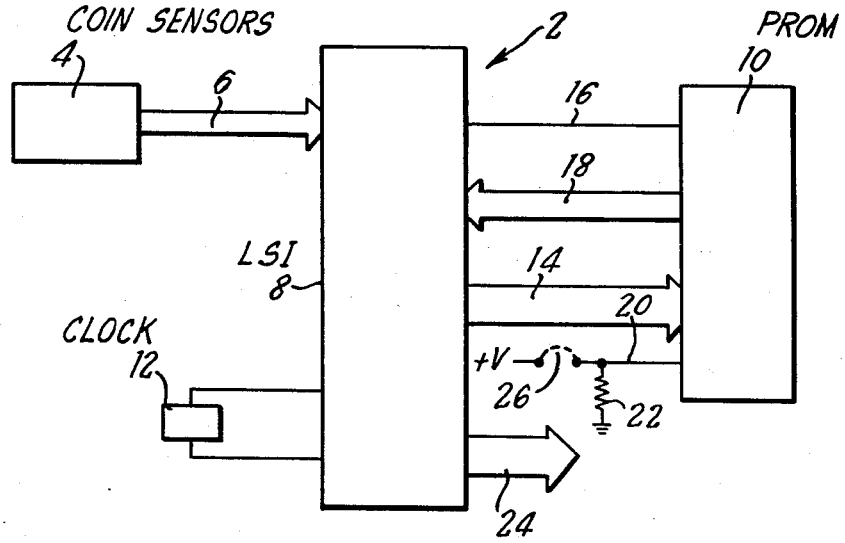

| | A | B | C | D | E | F |
|---|---|---|---|---|---|---|
| P1 | A-1-U | B-1-U | C-1-U | D-1-U | E-1-U | F-1-U |
| | A-1-L | B-1-L | C-1-L | D-1-L | E-1-L | F-1-L |
| P2 | A-2-U | B-2-U | C-2-U | D-2-U | E-2-U | F-2-U |
| | A-2-L | B-2-L | C-2-L | D-2-L | E-2-L | F-2-L |
| P3 | A-3-U | B-3-U | C-3-U | D-3-U | E-3-U | F-3-U |
| | A-3-L | B-3-L | C-3-L | D-3-L | E-3-L | F-3-L |

FIG. 3(A)

| | N | M | W | | | |
|---|---|---|---|---|---|---|
| P1 | N-1-U | M-1-U | W-1-U | | | |
| | N-1-L | M-1-L | W-1-L | | | |
| P2 | N-2-U | M-2-U | W-2-U | | | |
| | N-2-L | M-2-L | W-2-L | | | |
| P3 | N-3-U | M-3-U | W-3-U | | | |
| | N-3-L | M-3-L | W-3-L | | | |

FIG. 3(B)

COIN TESTING APPARATUS

This invention relates to a coin testing apparatus, and to a method of checking that a coin testing apparatus is operating correctly.

The performance of a coin testing apparatus can vary during use due to wear, and to alteration of electrical component values. It is therefore highly desirable to provide a way in which the operation of the coin testing apparatus can be easily checked without requiring highly skilled operations or expensive testing equipment.

One way of checking a coin testing apparatus is simply to insert coins of appropriate denomination and then see whether the coins are accepted or rejected. This, however, is unsatisfactory because the precise properties of the coins are not known, and even if these were measured in some way the properties would tend to vary over a long period of use. It could not be ensured that the operation of the coin testing apparatus throughout the full ranges of the parameters it is designed to test is being correctly checked.

It would be possible, although difficult, to provide sets of 'limit' coins which have properties corresponding to the limits of the acceptable ranges of parameters being tested. A different set of coins would be required for each denomination which the coin testing apparatus is designed to test. Such coins could very easily get mixed up with ordinary coins.

It is also undesirable to have in the field a large number of coins, whose total value would be very great, for checking coin testing apparatus.

According to one aspect of the invention there is provided a coin testing apparatus operable to recognise acceptable coins of one or more denominations by determining whether a measured coin property is within a respective acceptability range for the or each denomination, and operable to determine whether a measured property of an item which the apparatus is designed not to accept in the course of its normal operation is within a predetermined test range, which differs from the or each acceptability range, in order to check whether an aspect of the operation of the apparatus is being carried out correctly.

Preferably, the apparatus is operable to test several different properties of inserted coins and items.

During a checking operation, the apparatus will be testing for parameter values which are different from those of the coin or coins it is designed to accept. One can therefore test the apparatus by inserting an item which may have properties different from those of genuine coins.

One can therefore select any suitable object for use as a test item, and arrange for the apparatus to store parameter values appropriate to the selected item.

This has a number of advantages. The total cash value of those test items in the field will be much smaller than if genuine coins were to be used for testing purposes. As it is no longer necessary to use test items which are legal tender, or which are found acceptable during the normal operation of a coin testing apparatus, they would be less attractive to potential thieves. Further, a single test item can be designed to provide an adequate test of all the parameters being measured. If different coins require particularly critical measurements to be carried out on different properties, a single test item can be designed to test that all these critical measurements are being carried out accurately. Also, the test item can be made much more durable than genuine coins.

If the apparatus is designed to test more than one coin denomination, it will store a different set of parameter ranges for each denomination. The properties of the test item may fall within respective ones of these ranges. However, at least one of the ranges should be associated with a different denomination from the others. Otherwise the item would be recognised as an acceptable coin.

Preferably, the apparatus stores acceptability ranges for use in testing genuine coins in a first store, and has a second store which can be switched into operation in place of the first store during a test mode, and which stores predetermined test ranges.

In accordance with another aspect of the invention, a coin testing apparatus is operable to carry out a plurality of measurements on a coin, and to provide a signal indicating that the coin is acceptable only if each measured value falls within a respective one of a set of acceptability ranges, the apparatus being operable to provide a signal indicating that it is operating correctly upon measuring values which fall within respective ones of a first set of test ranges, and to provide a signal indicating that it is operating adequately but not optimally upon measuring values which fall within respective ones of a second set of test ranges each of which encompasses a respective one of said first set of test ranges and a region which is contiguous therewith.

Preferably, each of the second set of test ranges encompasses a respective one of the first set of test ranges, and contiguous regions located above and below the range of the first set.

By providing different signals depending upon how well the apparatus is operating, it is possible to achieve more efficient servicing by dealing first with those machines which require servicing most.

The testing operations are preferably carried out by inserting a test item, according to the first aspect of the invention described above.

The apparatus is desirably operable to test for different denominations of coins, in which case there would be more than one set of acceptability ranges. In a preferred embodiment, the sets of acceptability ranges are stored in a first store, and the first and second sets of test ranges in a second store which in a test mode is switched into operation in place of the first store. The locations of the first and second sets of test ranges within the second store preferably correspond to the locations of acceptability ranges for respective coin denominations within the first store. Using such an arrangement, it is simple to design the apparatus so that, during the test mode when a test item is inserted, an indication from the apparatus that it has received a coin of a first denomination represents that the measured properties of the test item fall within the first set of ranges, and an indication of a coin of a second denomination represents that the measured values fall within the test ranges of the second set.

There may also be a third set of test ranges which encompass and extend beyond the ranges of the second set. If the measured properties of the test item do not all lie within the ranges of the second set, but do lie within the ranges of the third set, the apparatus can provide an indication that it is operating poorly, and requires urgent servicing.

Our U.K. Pat. No. 1,452,740 describes a setting-up procedure whereby reference values are stored in a programmable memory so that in use the coin testing apparatus can compare measured values with the reference values to determine whether a coin is acceptable. This setting-up procedure is preferably also used for the coin testing apparatus of the present invention. In addition, a further setting-up procedure is preferably used to store reference values associated with the test item. This may be achieved by inserting the test item into the coin tester and using a computer which is responsive to the measured values of the properties of the item to generate a set of parameter ranges which are then, preferably, stored in a programmable read-only memory (PROM). Preferably, at least one further set of ranges is generated in response to the measured properties of the test item so as to enable one to test whether the apparatus is operating adequately, as distinct from optimally.

The invention also extends to a test item (referred to herein also as a test coin) for checking the operation of a coin testing apparatus. The properties of the test coin lie within predetermined ranges stored in the apparatus for use when the apparatus is undergoing a checking procedure, and at least one of the properties preferably falls within a further range which is used, in normal operation of the apparatus, to determine whether a coin is acceptable. The properties of the test item are, however, such that the item would not in normal use of the apparatus be recognised as an acceptable coin.

In a preferred embodiment, the test coin has a number of properties each of which falls within an acceptable parameter range for a different coin denomination. It may, for example, have an acceptable diameter for a 10p coin, and an acceptable conductivity for a 2p coin. In this way, the item can be used to check a number of different particularly critical testing operations associated with different coins.

One preferred form of test coin is made of a sintered tungsten/silver material, which is hardwearing and of consistent composition. Alternatively, the test item may, at least in part, be made of hardened or stainless steel. It may for example have a coating of steel. The coating may extend only around the rim of the coin.

Figure 2A:
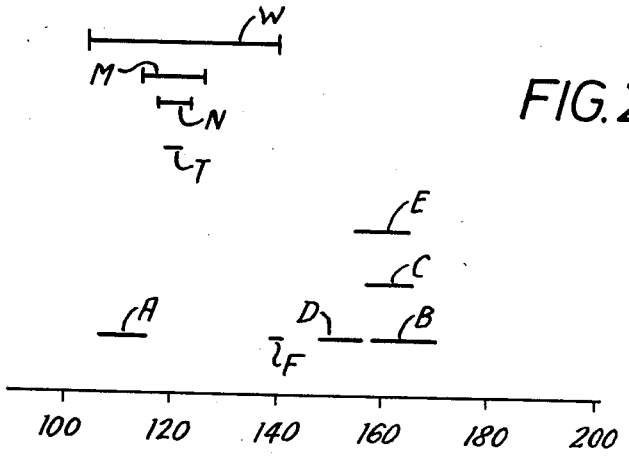
Figure 2B:
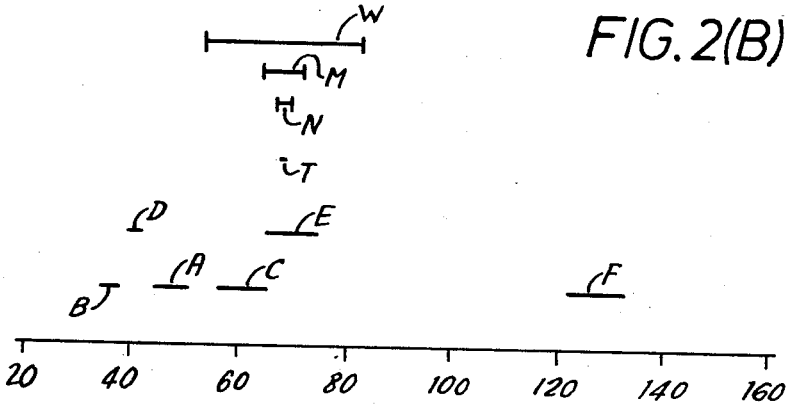
Figure 2C:
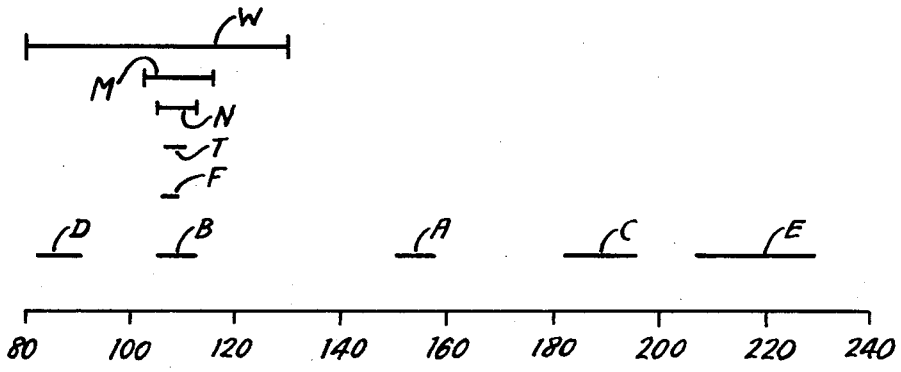

An arrangement embodying the invention will now be described by way of example with reference to the accompanying drawings, in which:

FIG. 1 is a schematic block diagram of a coin testing apparatus in accordance with the invention;

FIGS. 2(A) to 2(C) are diagrams showing ranges of values used for testing items inserted in the apparatus; and FIGS. 3(A) and 3(B) schematically indicate the contents of a parameter memory of the apparatus.

The coin testing apparatus 2 shown schematically in FIG. 1 has a set of coin sensors indicated at 4. Each of these is operable to measure a different property of a coin inserted in the apparatus, in a manner which is in itself well known. Each sensor provides a signal indicating the measured value of the respective parameter on one of a set of output lines indicated at 6.

An LSI 8 receives these signals. The LSI 8 contains a read-only memory storing an operating program which controls the way in which the apparatus operates. The LSI is operable to compare each measured value received on a respective one of the input lines 6 with upper and lower limit values stored in predetermined locations in a PROM 10 which may be a single integrated circuit.

The LSI 8, which operates in response to timing signals produced by a clock 12, is operable to address the PROM 10 by supplying address signals on an address bus 14, which may for example comprise address lines $A_0$ to $A_7$. The LSI also provides a "PROM-enable" signal on line 16 to enable the PROM.

In response to the addressing operation, a limit value is delivered from the PROM 10 to the LSI 8 via a data bus 18, which may for example comprise data lines $D_0$ to $D_3$.

The PROM 10 also has a further address input ($A_8$) indicated at 20. This is normally held at a low potential by a resistor 22 which connects the input to ground potential. The potential at the address input 20 determines which half of the PROM 10 is addressed by the signals on the address bus 14.

By way of example, one embodiment of the invention may comprise three sensors, for respectively measuring the conductivity, thickness and diameter of inserted coins. Each sensor comprises a coil in a self-oscillating circuit. In the case of the diameter and thickness sensors, a change in the inductance of each coil caused by the proximity of an inserted coin causes the frequency of the oscillator to alter, whereby a digital representation of the respective property of the coin can be derived. In the case of the conductivity sensor, a change in the Q of the coil caused by the proximity of an inserted coin causes the voltage across the coil to alter, whereby a digital output representative of conductivity of the coin may be derived. Although the structure, positioning and orientation of each coil, and the frequency of the voltage applied thereto, are so arranged that the coil provides an output predominantly dependent upon a particular one of the properties of conductivity, diameter and thickness, it will be appreciated that each measurement will be affected to some extent by other coin properties.

For an inserted coin to be found acceptable, its three measured properties must lie within preset ranges which have been determined using the procedure described in U.K. Pat. No. 1,452,740. By way of example, FIGS. 2(A) to 2(C) show the appropriate ranges for the conductivity, thickness and diameter measurements, for each of six coins A to F, on scales of arbitrary units. In this example, the coins are as follows:

| Coin Label | Coin Type (UK currency) |
|---|---|
| A | 2p |
| B | 5p |
| C | 10p |
| D | 20p |
| E | 50p |
| F | 1 |

The upper and lower limit values associated with these coins are stored in the half of the PROM 10 which is addressed when the potential at the address input 20 is low. The contents of this half of the PROM 10 are schematically illustrated in FIG. 3(A).

On insertion of a coin, the measurements produced by the three sensors 4 are compared with the values stored in the region of the PROM 10 shown in FIG. 3(A). Firstly, the thickness measurement is compared with the twelve values, representing the limits of six ranges for the respective coins A to F, in the row marked P1 in FIG. 3(A). If the measured thickness value lies within the upper and lower limits of the thickness range for a particular coin (e.g. if it lies between the upper and lower limits A-1-U and A-1-L for the coin A), then a "thickness flag" for that coin is set.

Subsequently, a similar operation is carried out for the diameter measurement, which is compared with the twelve upper and lower limit values in the row P2, which represent the upper and lower limits of the six diameter ranges for the coins A to F. There are six "diameter flags" for the respective coins, and each of these is set if the diameter measurement lies within the upper and lower limit values for the respective diameter range (e.g. the values A-2-U and A-2-L for the coin A).

The conductivity measurement is then compared with the limit values in the row marked P3, and "conductivity flags" for the six coins A to F are set depending upon whether the conductivity measurement lies between the upper and lower limit values for the respective conductivity range.

After the above operation, the thickness, diameter and conductivity flags for the coin A are checked, and if all three have been set the coin is determined to be a valid coin A, and the validation process terminates.

If one or more of the flags for the coin A have not been set, the three flags for the coin B are checked. The coin is determined to be of the type B, and the validation process terminated, if all of these flags have been set. Otherwise, the procedure continues for the rest of the coins C to F, the process terminating if all three flags for a particular coin have been found to be set. It will be appreciated that this procedure gives priority to the lower value coins, i.e. once an inserted coin has been found to have properties lying within the ranges for a particular denomination, the validation process terminates so that the apparatus will not determine whether or not the properties lie within the ranges for higher denominations.

If and only if all the measured values fall within the stored ranges for a particular coin denomination which the apparatus is designed to accept, the LSI 8 produces an ACCEPT signal on one of a group of output lines 24, and a further signal on another of the output lines 24 to indicate the denomination of the coin being tested.

If desired, the number of pins of the LSI 8 can be reduced by using multiplexing techniques to produce the output signals on the address bus 14 (or the data bus 18) instead of on a separate set of output lines 24.

The apparatus so far described operates in the same manner as that of our U.K. patent application No. 8104175 (Publication No. 2094008A).

The potential at the address input terminal 20 of the PROM 10 can be altered by connecting a link, indicated at 26, between the terminal and a supply voltage +V. This will cause the address signals on the bus 14 to address locations in the other half of the PROM 10 from that storing the limit values referred to above.

This other half of the PROM 10 contains further parameter values for use in a test mode of the apparatus, which is entered when the link 26 is connected. It will be appreciated that the actual operation of the LSI 8 is no different in this test mode from in the normal mode of operation; the only difference is in the values of the data accessed from the PROM 10 by the LSI.

The contents of the half of the PROM 10 which is accessed when the link is connected to the supply voltage +V are indicated in FIG. 3(B), from which it will be appreciated that only a portion of this half of the PROM 10 is required. The value stored in this half of the PROM 10 are the upper and lower limit values for narrow, medium and wide ranges N, M and W shown in FIGS. 2(A) to 2(C). The three ranges N, M and W for each of the properties are calculated on the basis of the ranges of values T which are produced on inserting a specially designed test item into a correctly operating apparatus. The upper and lower limit values for these ranges can be determined using a procedure corresponding to that described in U.K. Pat. No. 1,452,740.

In order to check the operation of the apparatus the test coin, or another test coin having very similar properties, is inserted into the apparatus and the signals produced by the coin sensors 4 are compared with the ranges stored in the second half of the PROM 10 which is brought into use in the test mode.

This second half of the PROM 10 stores a first 'test' set of ranges in column N which correspond (in terms of the addresses supplied on the address bus 14) to those locations in the first half of the PROM which store the upper and lower limit values for coin A. As shown in FIGS. 2(A) to (C), each range in this first 'test' set is relatively narrow, and is centred about the respective measured value produced when the test item was inserted in the apparatus during the setting-up procedure. Accordingly, during the test mode, the LSI 8 should detect that the properties of the inserted test coin fall within the ranges of this first set. It will therefore produce an ACCEPT signal on the appropriate one of the output lines 24, and a signal indicating the first coin denomination A on another of the output lines.

The signals on the output lines 24 are normally processed to operate a display to indicate the value of accepted coins, and therefore the person testing the apparatus can readily recognise that the apparatus is operating correctly on the production of a display of an appropriate value in response to the insertion of the test coin.

The second half of the PROM 10 also stores in column M, a second 'test' set of parameter ranges used to test the apparatus. This second set is stored at locations corresponding (in terms of the address signals on bus 14) to the locations of the upper and lower limit values for coin B stored in the first half of the PROM 10.

For each of the properties being measured, the second 'test' range M extends from below the lower limit of the first 'test' range N to a value which is higher than the highest limit of the first 'test' range N. Thus, the second range M encompasses and extends beyond the first range N, so that the range M includes regions which are contiguous with, and located respectively below and above, the range N.

If the coin testing apparatus is not working optimally, whereby one or more of the measurements is carried out slightly inaccurately, then not all the measurements will fall within the first set of ranges N. Accordingly, as in the coin validation procedure, the LSI 8 will proceed to compare the flags for the next set of ranges, which in this case comprises the ranges M. If the measurement inaccuracies are only small, then the measured values will all have fallen within the respective ranges M whereby all three flags will have been set and the LSI 8 will produce an output indicating an acceptable coin of the denomination B. When in the test mode, such an output indicates that the apparatus is working adequately, but not optimally, and that servicing should be carried out at an early stage, but not necessarily on an urgent basis.

Accordingly, the apparatus is able to determine not only whether the measurements fall within respective ranges N, but also whether the measurements fall within regions which are all contiguous with the respective ranges N.

If one or more of the measurements falls outside both the respective narrow range N and the medium-sized range M, the apparatus then proceeds to determine whether the flags for the respective ranges W have all been set. This procedure corresponds to that carried out to determine whether an inserted coin is of the denomination C.

If the apparatus produces signals indicating a coin of denomination C in response to insertion of the test coin in the test mode, then the user will realise that the apparatus is working poorly, and requires servicing quickly. On the other hand, if no acceptable coin is indicated, the person testing the apparatus will recognise that it is not operating correctly and should be taken out of service.

In the illustrated embodiment, all the above features are achieved simply by the provision of a link 26, and by the storing of appropriate values in the previously-unused second half of the PROM 10. If desired, a manually operable switch can be provided in place of the link 26.

Provision may be made for a different form of display to be generated in response to the output from the LSI 8 when the apparatus is in the test mode so that the actual information displayed more appropriately indicates whether or not the apparatus is operating correctly.

One preferred form of test coin for use in testing the operation of the apparatus described above comprises a disc of a sintered tungsten/silver material. This has been found particularly useful as the conductivity is approximately correct for testing a range of coins of U.K. currency, and the material is hardwearing. Further, by using material intended for electrical contacts, the purity and content is controlled accurately and it is therefore possible to obtain a stock of consistent quality.

The advantages of using a specially designed test item include the fact that the item can be so designed as to check on the accuracy of a number of different critical measurements which are particularly important for different types of coins. For example, it may be particularly important for the thickness of a 50p coin to be measured accurately, so that it can be correctly distinguished from other coins, but not so important for the thickness measurements in other regions to have the same accuracy. Also, it may be particularly important for diameter measurements of 5p coins to be particularly accurate, compared with diameter measurements in other regions. In this case, the test coin can be designed to have the thickness of a 50p coin and the diameter of a 5p coin. Accordingly, if the accuracy of measurement varies throughout the range of the respective property, it will nevertheless be ensured that the accuracy within the particular region of interest is being checked. If standard coins were to be used for testing, this could only be achieved by performing several testing operations using different coins.

Another advantage is that the specially-designed test item will not have any value as legal tender, and can be designed so that it is not acceptable by a coin testing apparatus in exchange for a vended product, a service, or other coins. Thus, the lack of any readily negotiable value will mean that the test items will not be so subject to theft as would be the case if standard coins were used. Further, they will be easily distinguishable between ordinary coins, which would not be the case if one were using specially selected 'limit' coins.

However, it is not essential that the test coin be a specially-manufactured item. Many of the above advantages may be achievable, for example, by selecting a coin of foreign currency having suitable properties for use as a test item. Indeed, some of the above advantages, particularly those arising from the ability of the apparatus to determine not only when measurements are being carried out correctly, but also when they are being carried out adequately but not optimally, could be achieved by testing using standard coins of the currency normally accepted by the apparatus.

In the above embodiment, the apparatus is switched to a test mode before insertion of the test item. If desired, this switching operation can also have the effect of inhibiting the normal operation that would ensue as a result of an ACCEPT signal appearing on one of the output lines 24; e.g. it can be arranged to prevent a product or service from being vended.

In addition, or alternatively, there is preferably provided a switch which causes the inserted test item to be directed to the return chute rather than to the storage locations used for acceptable coins. Thus, in the above embodiment, assuming that the apparatus is working optimally then insertion of a test item will cause the LSI to provide signals indicating the receipt of a coin of denomination A, but the switching means would cause the test item to be directed to the reject chute rather than to a storage tube containing coins of denomination A. This switching arrangement can be operated in response to switching the apparatus to the test mode, or alternatively a separate switch could be provided for this purpose.

In a modification of the embodiment, the apparatus can be tested without requiring a switching operation to switch the apparatus into a test mode. Thus, there is no longer any need for a switch, or terminals for a link, which would normally be located inside the housing of the apparatus, and would require the opening of the housing. Testing can be carried out simply by inserting the test item.

A convenient way of achieving this would be to arrange for the address bus 14 of the LSI 8 to be capable of addressing all those locations in the PROM 10 which store the parameter ranges for acceptable coins and for the 'test' ranges N, M and W. Thus, the LSI 8 would have an extra address terminal connected to the address input 20 of the PROM 10.

In such an embodiment, the machine would preferably be designed so that any inserted item falling within one of the 'test' ranges N, M and W would be delivered to a reject chute, to avoid the need for opening the machine in order to retrieve the test item.

The various modifications described above, which involve a change in the way in which the apparatus operates compared with the operation of the apparatus described in published U.K. patent application No. 2094008A, can be achieved in a simple manner by altering the operating program in the read-only memory of the LSI 8. This program defines how various gates in the apparatus are controlled for directing the coins to appropriate locations, and it is a simple matter to alter the program in order to direct inserted coins or test items to different locations.

In the above embodiments, the PROM 10 contains values representing upper and lower limits of various ranges. This, however, is not essential. It is possible instead to store a particular value for each range, the LSI 8 being operable to determine whether a measured property lies within a predetermined offset from the stored value in order to detect whether the measured property lies within the respective range. The predetermined offset may differ for different ranges, or different sets of ranges, in which case it is possible for the respective offset values also to be stored in the PROM 10.

We claim:

1. A coin testing apparatus operable to provide a signal indicating that a coin is acceptable, to provide a signal indicating that the coin testing apparatus is operating correctly, and to provide a signal indicating that it is operating adequately but not optimally, said coin testing apparatus comprising a plurality of means for testing a coin and producing measured values indicative of characteristics of the coin, memory means for storing a set of values establishing a set of acceptability ranges, a first set of values establishing a first set of test ranges, and a second set of values establishing a second set of test ranges, each of said second set of test ranges encompassing a respective one of said first set of test ranges and a region which is contiguous therewith, means for providing a signal indicating that the coin is acceptable only if each measured value for the coin falls within one of the stored acceptability ranges, and means to provide a signal indicating that the coin testing apparatus is operating correctly if the measured values for an inserted test coin fall within one of the first set of test ranges, and to provide a signal indicating that it is operating adequately but not optimally if the measured values for the test coin fall within one of the second set of test ranges.

2. Apparatus as claimed in claim 1, wherein each of said second set of test ranges encompasses a respective one of said first set of test ranges and contiguous regions located above and below said respective range of said first set.

3. Apparatus as claimed in claim 1 or claim 2, wherein the apparatus includes a first switch means for switching from a normal mode in which coin authenticity is tested to a test mode in which it is determined whether the measured values for the test coin fall within the first or second set of test ranges.

4. Apparatus as claimed in claim 3, including a second switch means which can be operated to cause the test coin to be directed to a return passage of the apparatus for retrieval from the apparatus if its measured values fall within said first or second set of test ranges.

5. Apparatus as claimed in claim 4, wherein said second switch means is automatically operated when the machine is switched into the test mode.

6. Apparatus as claimed in claim 1 or claim 2 further comprising a coin return passage and means for automatically directing the test coin to the coin return passage for retrieval from the apparatus if the measured values for the test coin fall within the first or second set of test ranges.

7. Apparatus as claimed in claim 1 or claim 2, wherein the memory means stores a third set of test ranges each of which encompasses and extends beyond a respective one of the second set of test ranges, and the apparatus is further operable, on finding that not all the measured values for the test coin fall within the second set of test ranges, to determine whether the measured values fall within the third set of test ranges

8. Apparatus as claimed in claim 1 or claim 2, wherein the memory means comprises a first store containing data defining acceptability ranges for a variety of denominations of coins, the data for each of the acceptability ranges stored at a plurality of predetermined positions, and a second store containing data defining said test ranges, the data defining each set of test ranges being located within the second store at positions corresponding to the positions of the data defining acceptability ranges for a respective one of the denominations.

9. A coin testing apparatus operable to recognize acceptable coins of one or more acceptable denominations, and to check whether an aspect of the operation of the apparatus is being carried out correctly, said coin testing apparatus comprising means for measuring values indicative of coin properties, means for storing an acceptability range for an acceptable coin, and to store a test range which differs from the acceptability range for an acceptable coin, and means for determining whether a measured value indicative of a coin property is within the acceptability range for an acceptable coin, and for determining whether a measured property of a test coin which the apparatus is designed not to accept in the course of its normal operation is within the test range.

10. Apparatus as claimed in claim 9, further comprising means to indicate that said aspect of the operation of the apparatus is being performed correctly, said means to indicate being operable in response to testing the test coin and measuring a measured value indicative of a coin property which falls within said predetermined test range to indicate that said aspect of the operation of the apparatus is being performed correctly.

11. Apparatus as claimed in claim 9, further including a switch means for switching the apparatus into and out of a test mode in which the apparatus is capable of determining whether said measured property falls within said predetermined test range only when it is switched into the test mode.

12. Apparatus as claimed in claim 11, wherein the memory means comprises a first store for storing data defining a predetermined acceptability range within which a measured value indicative of a property of a coin must fall for the apparatus to recognize it as a genuine coin, and a second store for storing data defining said predetermined test range, the second store being brought into use in place of the first store during said test mode.

13. Apparatus as claimed in claim 12, wherein said first and second stores are addressable by a common address bus which includes an address line the potential of which can be altered to switch into and out of said test mode.

14. Apparatus as claimed in claim 12, further comprising means to provide a signal indicating that the apparatus is operating adequately but not optimally on testing the test coin and measuring a property which falls outside said predetermined test range, but within a further, contiguous region.

15. Apparatus as claimed in claim 14, wherein said first store comprises at least two sections each containing data determining an acceptability range for a respective denomination of coin, said second store comprising at least two sections containing data determining said test range and said further contiguous range, said two or more sections of the second store being located within the second store at positions corresponding to the locations of said two or more sections within the first store.

16. Apparatus as claimed in claim 14, further comprising means to provide a signal indicating that a genuine coin has been tested, and to indicate that an aspect of the apparatus is operating correctly, said means being operable to provide a signal indicating that a genuine coin has been tested only if a plurality of different measured values indicative of the properties of the coin fall within predetermined acceptability ranges for the respective properties, and operable to indicate that an aspect of the apparatus is operating correctly only on measuring a plurality of different measured values indicative of the properties of the test coin which fall within predetermined test ranges for the respective properties.

17. Apparatus as claimed in claim 14, further comprising means to indicate that the apparatus is operating correctly, said means being operable to indicate that the apparatus is operating correctly on testing the test coin where at least one, but not all, of the measured values for the test coin are indicative of coin properties falling within the predetermined acceptability ranges for the respective properties.

18. Apparatus as claimed in claim 16 or claim 17, wherein the means to provide a signal indicating that the apparatus is operating adequately but not optimally is operable to provide the signal indicating that the apparatus is operating adequately but not optimally on measuring a plurality of different properties of the test coin and determining that at least one of the properties falls outside the predetermined test range for that property but within a further, contiguous range for that property.

19. Apparatus as claimed in any one of claims 9 to 17, further comprising a coin return passage and means to automatically direct the test coin whose measured value indicative of a property of the test coin has been found to be within said predetermined test range to the coin return passage for retrieval from the apparatus.

20. Apparatus as claimed in any one of claims 9 to 17, comprising switch means selectively operable to cause an inserted test coin whose property has been found to lie within said predetermined test range to be directed to a return passage of the apparatus for retrieval from the apparatus.

21. A method of checking an aspect of the operation of a coin testing apparatus, the method comprising the steps of storing an acceptability range for an acceptable coin and a first predetermined test range which differs from the acceptability range for an acceptable coin, inserting into the apparatus a test coin which the apparatus is designed not to accept in the course of its normal operation, measuring a value indicative of a property of the test coin, determining whether the measured value lies within the first predetermined test range, and producing a signal indicating that the coin testing apparatus is operating correctly when the measured value is determined to lie within the first predetermined test range.

22. The method of claim 21 further comprising the steps of storing a second predetermined test range, determining whether the measured value lies within the second predetermined test range, and producing a signal indicating that the coin testing apparatus is operating adequately but not optimally when the measured value is determined to lie within the second predetermined test range.

23. The method of claim 21 further comprising the step of directing the test coin to a coin return passage for retrieval by the operator.

24. The method of claim 21 further comprising the step of switching the coin testing apparatus to a test mode.

25. The method of claim 21 wherein the test coin has a plurality of properties and is used to test whether a plurality of operations of the coin testing apparatus are functioning properly.

* * * * *